US007854806B2

(12) United States Patent
Cho et al.

(10) Patent No.: US 7,854,806 B2
(45) Date of Patent: Dec. 21, 2010

(54) DISHWASHER AND METHOD OF CONTROLLING THE SAME

(75) Inventors: In Haeng Cho, Changwon-si (KR); Joung Hun Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 214 days.

(21) Appl. No.: 10/576,085

(22) PCT Filed: Sep. 9, 2005

(86) PCT No.: PCT/KR2005/002990

§ 371 (c)(1),
(2), (4) Date: Apr. 14, 2006

(87) PCT Pub. No.: WO2006/028357

PCT Pub. Date: Mar. 16, 2006

(65) Prior Publication Data

US 2009/0014032 A1 Jan. 15, 2009

(30) Foreign Application Priority Data

Sep. 9, 2004 (KR) ..... 10-2004-0072131

(51) Int. Cl.
*B08B 7/04* (2006.01)

(52) U.S. Cl. ..... 134/18

(58) Field of Classification Search ..... 134/57 DL, 134/58 DL, 18, 56 D, 56 R, 57 D, 57 R, 58 D, 134/58 R See application file for complete search history.

(56) References Cited

U.S. PATENT DOCUMENTS

| | | | | |
|---|---|---|---|---|
| 4,730,630 | A * | 3/1988 | Ranft | 134/111 |
| 5,264,043 | A * | 11/1993 | Milocco | 134/25.2 |
| 5,494,062 | A | 2/1996 | Springer | |
| 2003/0221709 | A1 * | 12/2003 | Jung et al. | 134/18 |
| 2006/0054198 | A1 * | 3/2006 | Choi | 134/56 D |

FOREIGN PATENT DOCUMENTS

| | | |
|---|---|---|
| JP | 06-062998 A | 3/1994 |
| JP | 07-059707 A | 3/1995 |
| KR | 10-1999-0004058 | 1/1999 |
| KR | 10-2004-0045729 | 6/2004 |

OTHER PUBLICATIONS

International Search Report dated Dec. 14, 2005.

* cited by examiner

*Primary Examiner*—Michael Kornakov
*Assistant Examiner*—Stephen Ko
(74) *Attorney, Agent, or Firm*—McKenna Long & ALdridge LLP

(57) ABSTRACT

A controlling method of a dishwasher is provided. The method includes a selecting of a wash cycle and inputting of command settings by a user, starting operation of the dishwasher according to the selected cycle and driving a wash pump and discharge member, and controlling the dishwasher during the cycle to end the wash cycle with an upper arm operating.

5 Claims, 3 Drawing Sheets

DISHWASHER AND METHOD OF CONTROLLING THE SAME

This application claims priority to International application No. PCT/KR2005/002990 filed on Sep. 9, 2005, Korean Application No. 10-2004-72131 filed on Sep. 9, 2004, both of which are incorporated by reference, as if fully set forth herein.

TECHNICAL FIELD

The present invention relates to a dishwasher, and more particularly, to a dishwasher and a method of controlling the dishwasher that always discharges the final wash liquid of a dishwashing cycle through an upper arm.

BACKGROUND ART

A dishwasher is a home appliance that washes dishes by discharging high-pressure wash liquid through discharge members onto the dishes to remove impurities thereon.

In more detail, a dishwasher includes a tub forming a space inside the dishwasher for holding dishes to be washed, dish racks installed to slide in and out of the tub for holding dishes, discharge members installed inside the tub for spraying wash liquid, a sump disposed at the bottom of the tub for holding wash liquid, a wash pump assembly attached to a side of the sump for pumping the wash liquid contained in the sump to the discharge members, and a drain pump assembly for draining dirty wash liquid after dish washing is completed.

The discharge members consist of a lower arm installed above the sump, and an upper arm and a top nozzle connected to a water guide installed on an interior surface of the tub. Wash liquid is alternately pumped to the lower arm and the water guide by means of a switching valve located in the sump. In other words, during a wash cycle, the wash liquid that is alternately pumped by means of the switching valve is intermittently pumped at a predetermined interval to the lower and upper arms.

In conventional dishwashers, the running time of a dishwashing cycle and the switching intervals of the switching valve are dependant on the settings inputted by a user. Accordingly the final discharge member to discharge wash liquid before a wash cycle ends could be the upper arm or the lower arm.

However, if the lower arm is the final discharge member to discharge wash liquid in a wash cycle, the impurities present on dishes in the lower rack are sprayed up to dishes on the upper rack, resulting in impurities left on dishes after a wash cycle. However, when wash liquid is discharged from the upper arm, the dishes on the upper rack are washed, and the water settles to the bottom of the tub through gravity. Accordingly, even when the water falls on the dishes in the bottom rack, the deposits on those dishes settle and collect on the floor of the tub along with the water.

The lower arm has its spray holes defined by its upper surface (and some on its lower surface), and the lower rack is positioned directly above the lower arm. Therefore, when wash liquid is sprayed upward through the lower arm, the impurities on the dishes in the lower rack are sprayed upward onto the dishes in the upper rack and the upper walls of the tub. Resultantly, even after the wash cycle is completed, impurities are left remaining on the dishes in the upper rack, compromising dishwashing effectiveness and giving users an unsanitary impression.

DISCLOSURE

Technical Problem

An object of the present invention is to provide a dishwasher and a method of controlling the dishwasher that allows the machine to always select the upper arm as the discharge member dispensing wash liquid just before the dishwasher completes a wash cycle. In this way, dishwashing effectiveness can be increased, and consumers' dissatisfaction can be reduced.

Technical Solution

To achieve these objects and other advantages and in accordance with the purpose of the invention, as embodied and broadly described herein, a dishwasher according to the present invention includes: a control panel for a user to input commands with; a controller for controlling the dishwasher to perform each cycle according to the commands inputted into the control panel, and ensuring that a wash cycle is always completed by an upper arm; and a load driver for controlling an operation of a wash pump and a discharge member according to a control signal from the controller.

According to another aspect of the present invention, there is provided a controlling method of a dishwasher including: selecting a wash cycle by a user and inputting operation commands; beginning a cycle according to the selected wash cycle and operating a wash pump and a discharge member; and controlling the dishwasher during a cycle to ensure that the wash cycle ends with the operation of an upper arm.

According to a further aspect of the present invention, there is provided a controlling method of a dishwasher that includes designating the final operating discharge member of the wash cycle as the upper arm in the operation of the discharge member switching between the upper arm and the lower arm.

Advantageous Effects

The above-described dishwasher and controlling method for the dishwasher according to the present invention, by always designating the upper arm as the final nozzle to discharge wash liquid in a wash cycle, reduces the amount of impurities left on the upper regions of the tub during the wash cycle for better cleanliness.

Also, by minimizing the amount of residual impurities in a wash cycle, the overall washing performance of the dishwasher increases.

In addition, by increasing the dishwasher's washing capability, the satisfaction of consumers who use the machine increases.

DESCRIPTION OF DRAWINGS

The spirit of the present invention can be understood more fully with reference to the accompanying drawings. In the drawings.

BEST MODE

Hereinafter, preferred embodiments of a dishwasher according to the present invention will be described in detail with reference to the accompanying drawings.

Figure 1:
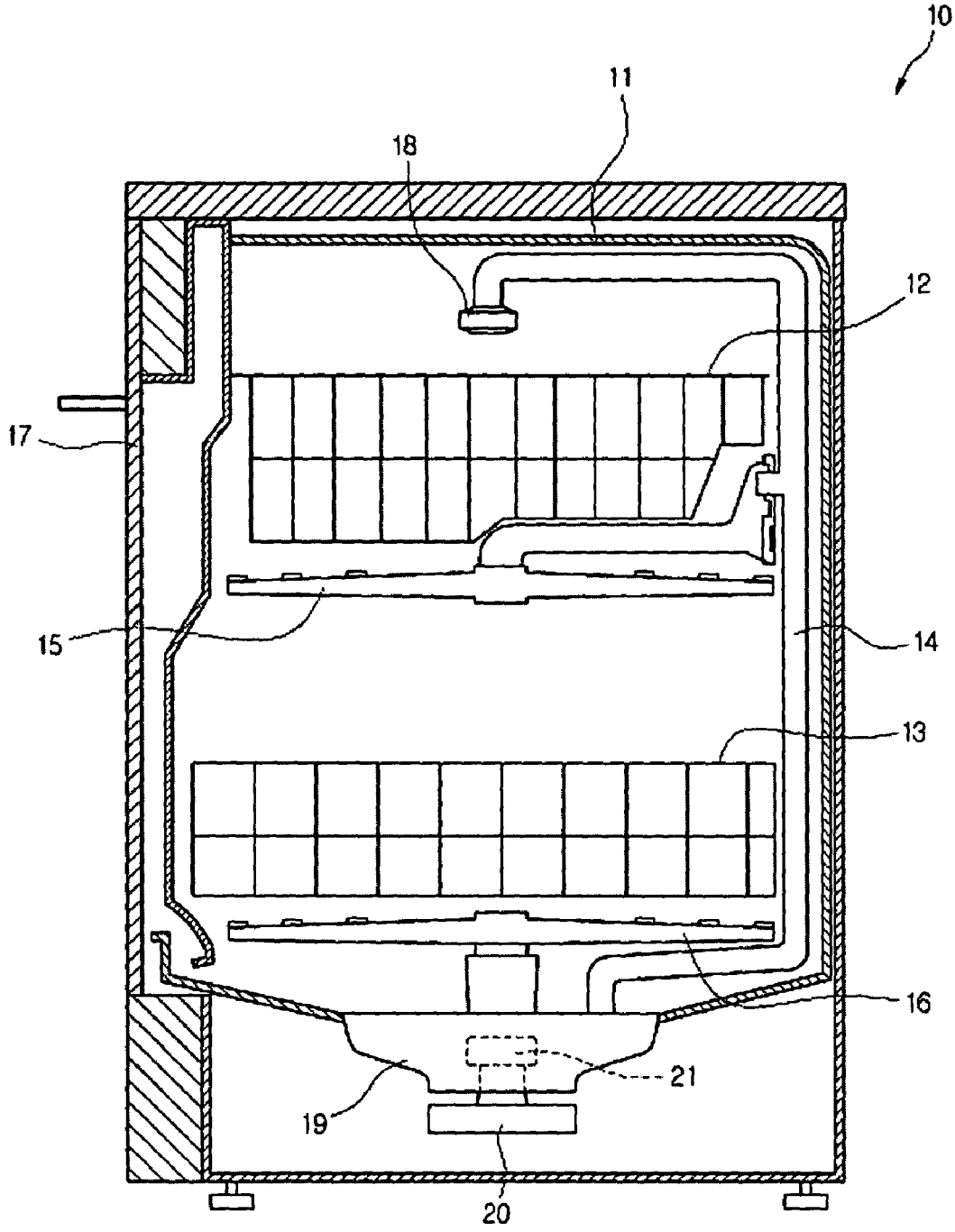
FIG. 1 is a schematic sectional view showing the structure of a dishwasher according to the present invention.

FIG. 1 is a schematic sectional view showing the structure of a dishwasher according to the present invention.

Referring to FIG. 1, the dishwasher 10 includes a tub 11 forming the outer shape and an inner washing compartment of the dishwasher 10, a door 17 formed at the front of the tub 11 for opening the dishwasher 10, and a sump 19 formed at the bottom central portion of the tub 11 for holding wash liquid.

The dishwasher 10 also includes a wash pump 21 installed in the sump 19 for pumping wash liquid, a wash motor 20 for driving the wash pump 21, a water guide 14 connected to the sump 19 for guiding wash water pumped by the wash pump 21, an upper arm 15 branching off from the water guide 14 and spraying wash liquid inside the tub 11, a top nozzle 18 connected to the top end of the water guide 14, and a lower arm 16 connected at the upper central portion of the sump 19 and spraying wash liquid pumped by the wash pump 21.

Further included is an upper rack 12 installed to slide in and out of the tub 11 above the upper arm 15, and a lower rack 13 disposed above the lower arm 16. Dishes are stored in the upper and lower racks 12 and 13.

An explanation of the operation of the above-described dishwasher according to the present invention will now be given.

First, a user opens the door 17, pulls out the dish racks 12 and 13, and places dirty dishes therein. After closing the door 17, power to the dishwasher 10 is turned on and a wash cycle setting is inputted. When a start button is pressed, wash liquid flows into the sump 19 and is intermittently pumped by the wash pump 21 to flow to the water guide 14 and the lower arm 16. At the last stage of the wash cycle, a controller determines whether the wash liquid is being discharged from the upper arm 15 or the lower arm 16. The controller ensures that the last nozzle to discharge wash liquid in the wash cycle is the upper arm 15.

When a wash cycle is completed, dirty wash liquid is drained by means of a drain pump (not shown), and clean wash liquid flows into the sump 19. The wash pump 21 then operates to begin a rinse cycle. After the rinse cycle is completed, the wash liquid is drained out of the dishwasher, and a drying cycle begins.

Figure 2:
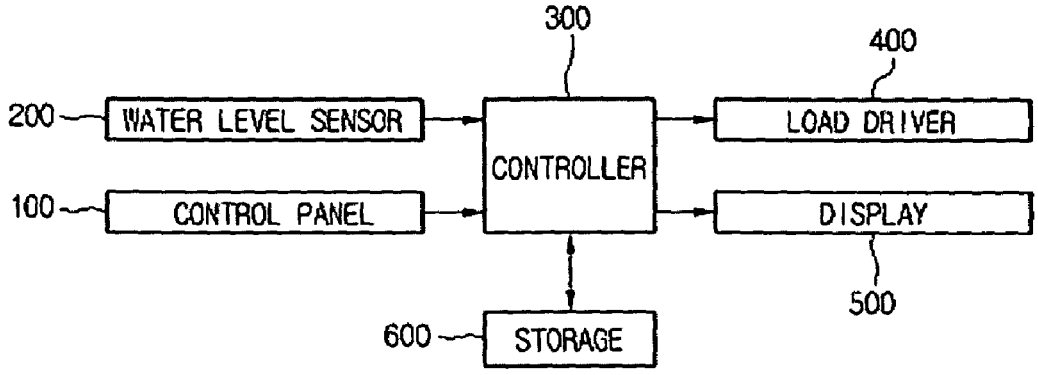
FIG. 2 is a block diagram showing the controlling structure of a dishwasher according to the present invention.

FIG. 2 is a block diagram showing the controlling structure of a dishwasher according to the present invention.

Referring to FIG. 2, the dishwasher 10 according to the present invention includes: control panel 100 for inputting commands by a user, a water level sensor 200 for sensing the level of wash liquid that enters the sump 19, a controller 300 for implementing a wash cycle according to the settings inputted into the control panel 100 and controlling the running time of the wash pump 21, a load driver 400 for operating the wash pump 21 and other devices according to control signals from the controller 300, a display 500 for displaying the operational status of the dishwasher according to a signal from the controller 300, and a storage 600 for storing various control values, menus, etc. that apply to the dishwashing processes.

An explanation of the operation of the above-described dishwasher according to the present invention will now be set forth.

First, a user turns on power to the dishwasher through the control panel 100, and selects a desired course setting. Then, the controller 300 implements the operation of the wash cycle selected by the user, and determines whether the wash cycle has begun. Here, the determining of whether the wash cycle has begun may be done by sensing if the wash pump 21 is operating.

Specifically, when the wash pump 21 begins its operation, the switching valve installed inside the sump 19 intermittently switches the flow of wash liquid to be discharged from the upper and lower arms according to operation time settings. After the wash pump 21 operates for a set duration, the controller 300 switches the discharge member, and enables wash liquid to be discharged through the switched nozzle for a set duration. After wash liquid has been discharged over a set duration through the switched nozzle, the controller 300 senses the location of the current discharge member, and ensures that the upper arm is designated as the final discharge member to end the wash cycle.

The following is a detailed explanation on the control method of the dishwasher according to the present invention using a flowchart.

Figure 3:
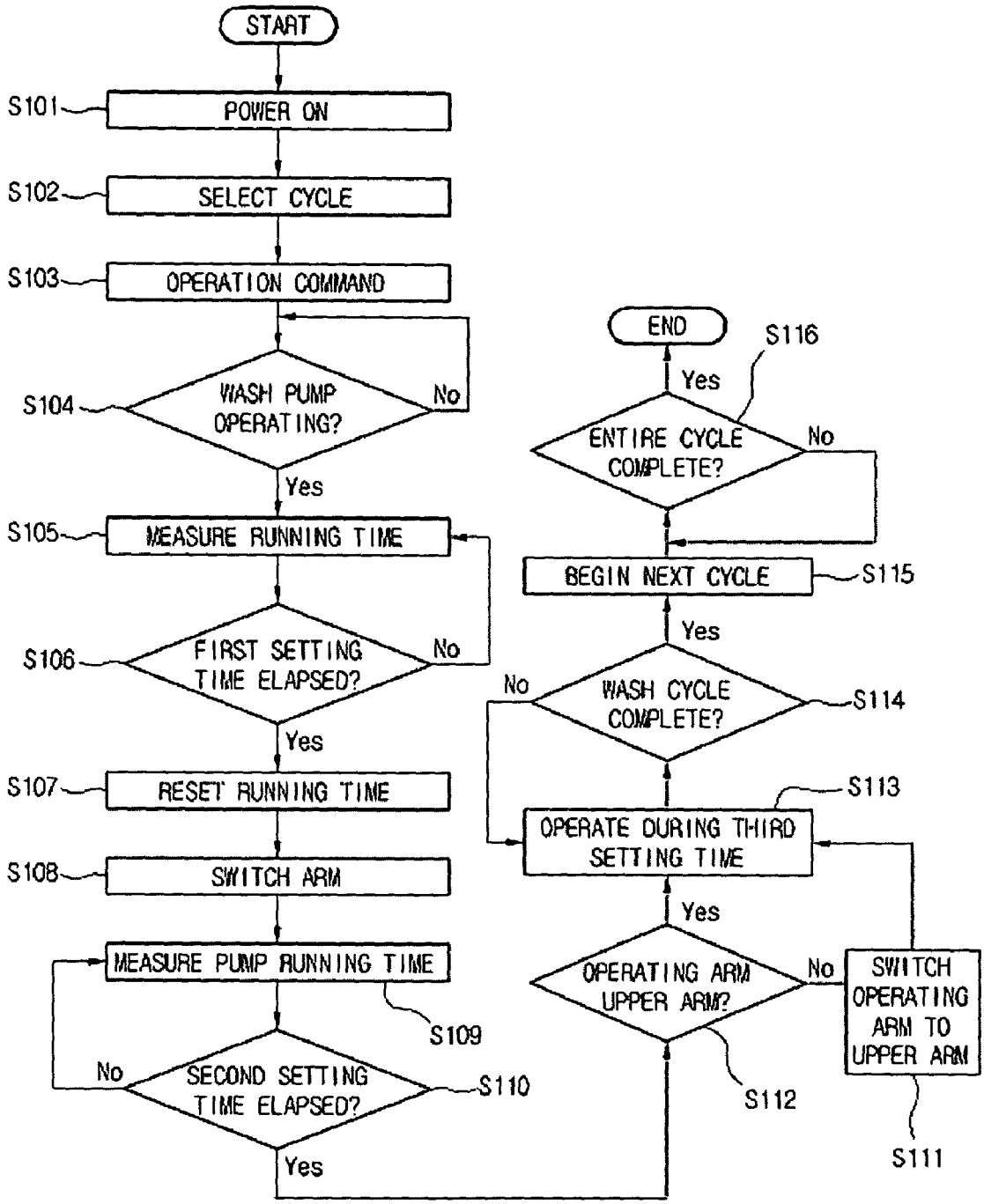
FIG. 3 is a flowchart showing a controlling method of a dishwasher according to the present invention.

FIG. 3 is a flowchart showing a controlling method of a dishwasher according to the present invention.

Referring to FIG. 3, a user first enters the command to switch power on to the dishwasher 10 in step S101, and enters a desired course setting and options in step S102. Next, a start button is pressed for activating the dishwasher in step S103. When the start button is pressed, operation of the dishwasher begins in accordance with the selected course. The dishwasher's operation according to the selected course begins with the operation of the wash pump.

When operation of the selected cycle commences, the controller determines if the wash pump 21 is operating in step S104. If the wash pump 21 is found to be operating, the running time of the wash pump 21 is measured in step S105 by the controller. Step S106 determines whether the running time of the wash pump 21 exceeds a first setting time. If the first setting time is not exceeded, the running time is continuously measured. If the first setting time is found to be exceeded, the running time of the wash pump 21 is reset at 0 in step S107. Simultaneously, the discharge member is switched in step S108.

Subsequently, when the discharge member is switched, the running time of the wash pump 21 is re-measured in step S109. Step S110 determines whether the running time of the wash pump 21 exceeds a second setting time. If the second setting time is found to be exceeded, the controller determines whether the current discharge member is the upper arm in step S111.

If the discharge member is found not to be the upper arm, the controller switches the discharge member to the upper arm in step S112. When the discharge member is switched to the upper arm, the wash pump 21 operates for a duration of a third setting time. Although not shown in the flowchart, the measurement of the wash pump's 21 operation from the time that the upper arm is designated as the discharge member is explained as follows.

When it is determined in step S114 that the third setting time has elapsed and the wash cycle has been completed, the next cycle is performed in step S115. When the entire dishwashing cycle has been completed, the operation of the dishwasher ends in step S116.

In the above controlling method, the upper arm is always designated as the final discharge member at the end of a wash cycle, to improve the washing effectiveness of a dishwasher.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The controlling method for a dishwasher according to the present invention designates the upper arm as the final operating nozzle in a wash cycle, so that no impurities are left remaining on the inner surfaces of the tub or the upper rack, etc. when the next cycle is begun. Accordingly, the washing effectiveness of the dishwasher increases for a high industrial applicability.

The invention claimed is:

1. A controlling method for a dishwasher, comprising:

selecting a wash cycle by a user and inputting operation commands;

beginning a cycle according to the selection of the wash cycle and operating a wash pump and a discharge member, the discharge member switching between an upper arm and a lower arm, the switching of the discharge member between the upper arm and the lower arm occurring at least once;

determining by a controller whether the switched discharge member is the upper arm after elapsing predetermined time from beginning the wash cycle;

switching the discharge member to the upper arm when the determined discharge member is the lower arm;

operating the upper arm for a setting time;

finishing the wash cycle after operating the upper arm for a setting time; and operating other cycles if the wash cycle has been completed.

2. The controlling method of claim 1, wherein the operation of the discharge member has a running time depending on the operation of the wash pump.

3. The controlling method according to claim 1, wherein operating the wash pump and the discharge member includes switching the discharge member by the controller when the running time of the wash pump reaches a first setting time.

4. The controlling method according to claim 3, further comprising operating a switched discharge member from the time of switching the discharge member until the running time of the wash pump reaches a second setting time.

5. The controlling method according to claim 4, wherein the determining operation is performed when the running time of the wash pump reaches the second setting time.

* * * * *